US006565708B2

(12) United States Patent
Ikeda et al.

(10) Patent No.: US 6,565,708 B2
(45) Date of Patent: May 20, 2003

(54) PAPER QUALITY IMPROVER COMPOSITION FOR PAPERMAKING

(75) Inventors: Yasushi Ikeda, Wakayama (JP); Takaaki Tadokoro, Wakayama (JP); Hiromichi Takahashi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/739,100

(22) Filed: Dec. 19, 2000

(65) Prior Publication Data

US 2002/0117278 A1 Aug. 29, 2002

(30) Foreign Application Priority Data

Dec. 24, 1999 (JP) ..... 11-366717
May 24, 2000 (JP) ..... 2000-153270

(51) Int. Cl.[7] ..... D21H 17/03; D21H 17/33

(52) U.S. Cl. ..... 162/158; 162/72; 162/168.1; 162/5

(58) Field of Search ..... 162/111, 112, 162/158, 164.1, 164.7, 164.6, 166, 167, 168.1, 168.2, 168.3, 168.7, 175, 179; 219/219, 243; 106/219, 243, 162.1

(56) References Cited

U.S. PATENT DOCUMENTS

| | | | | | |
|---|---|---|---|---|---|
| 2,694,633 | A | | 11/1954 | Pattilloch et al. | 162/182 |
| 3,293,114 | A | | 12/1966 | Kenaga et al. | 106/243 |
| 4,217,425 | A | * | 8/1980 | Ballweber et al. | 525/155 |
| 4,303,471 | A | * | 12/1981 | Laursen | 162/158 |
| 4,309,182 | A | | 1/1982 | Koll et al. | 8/527 |
| 4,441,962 | A | * | 4/1984 | Osborn, III | 162/111 |
| 5,302,249 | A | * | 4/1994 | Malhotra et al. | 162/135 |
| 5,472,486 | A | | 12/1995 | Dragner et al. | 162/168.7 |
| 5,510,003 | A | * | 4/1996 | Colasurdo et al. | 162/158 |
| 5,746,814 | A | * | 5/1998 | Mahotra et al. | 106/18 |
| 5,882,478 | A | * | 3/1999 | Schroeder | 162/111 |
| 6,001,920 | A | * | 12/1999 | Ghafoor et al. | 524/500 |
| 6,171,444 | B1 | * | 1/2001 | Nigam | 162/158 |

FOREIGN PATENT DOCUMENTS

| | | | |
|---|---|---|---|
| EP | 0860547 A2 | 8/1998 | |
| EP | 1001082 | 5/2000 | D21H/17/14 |
| EP | 1016755 A2 | 7/2000 | |
| JP | 3124895 | 5/1991 | D21H/17/67 |
| JP | 3269199 | 11/1991 | D21H/27/00 |
| JP | 4185792 | 7/1992 | D21H/13/00 |
| JP | 5230798 | 9/1993 | D21H/27/00 |

* cited by examiner

*Primary Examiner*—Peter Chin
*Assistant Examiner*—Eric Hug
(74) *Attorney, Agent, or Firm*—Birch, Stewart, Kolasch & Birch, LLP

(57) ABSTRACT

The present invention provides a paper quality improver composition for papermaking, which is excellent in improved efficiencies of bulky value, brightness, opacity and the like of pulp sheet, demanded at lightening paper and increasing a blending amount of deinked pulp, even by adding a small amount thereof as well as which is further excellent in an improved efficiency of paper-strength. That is, the present invention provides a paper quality improver composition for papermaking; which comprises (A) a compound having lyotropic degree measured by a specific method of not less than 4% and satisfying at least two of (i) standard improved bulky value of not less than 0.02 g/cm$^3$, (ii) standard improved brightness of not less than 0.5 point, and (iii) standard improved opacity of not less than 0.5 point and (B) a water-soluble polymer satisfying an average molecular weight and/or a viscosity thereof of specific value.

11 Claims, No Drawings

PAPER QUALITY IMPROVER COMPOSITION FOR PAPERMAKING

TECHNICAL FIELD OF THE INVENTION

The present invention relates to a paper quality improver composition for papermaking, which can improve bulky value and optical properties such as brightness and opacity of a sheet obtained from a pulp feedstock by papermaking as well as which can improve a paper-strength.

PRIOR ART

From the viewpoint of conservation of the environment in earth, a reduction in the used amount of pulp is demanded. As a result, it has been demanded to make paper light and to increase the blending amount of deinked pulp. However, paper obtained by merely reducing the amount of pulp in the paper becomes thin so that its opacity becomes low. Thus, its quality becomes poor. According to the lightening of paper based on reducing the amount of pulp, about paper for which stiffness in proportion to cube of thickness is required, such as paperboard, its stiffness is unfavorably lowered. On the other hand, if the blending ratio of deinked pulp is raised, brightness is lowered by remaining ink or the like in the deinked pulp. Moreover, the pulp itself becomes skinny in recycle process so that the thickness of the resultant paper is lowered. Thus, its opacity becomes low. Accordingly, if amount of the pulp in paper is reduced as well as the blending ratio of deinked pulp is raised, the opacity and the brightness of the obtainable paper are lowered still more. Further, it is not preferable that opacity of obtained paper is reduced still more, if brightness of deinked pulp which makes brightness low is raised by deinking and/or bleaching.

In order to prevent the thickness of paper from being lowered by lightening the paper, hitherto various bulky value improving methods have been attempted. For example, about a producing method of making press pressure low, there arises a problem that smoothness is lowered so that printability becomes poor. Examples of the attempts also include methods in which a crosslinked pulp is used (JP-A 4-185792, etc), in which a mixture of pulp with synthetic fibers is used as a feedstock for papermaking (JP-A 3-269199, etc), in which spaces among pulp fibers are filled with a filler such as an inorganic substance (JP-A 3-124895, etc), and in which spaces are formed (JP-A 5-230798, etc). However, pulp cannot be recycled or smoothness of paper is damaged. Although there is known a paper bulking promoter disclosed in WO99/63156 (corresponding to EP-A 1001082 A1 and JP-B 2971447), a paper-strength performance is insufficient.

On the other hand, in order to improve opacity and brightness, a method of adding a large amount (e.g., 5 to 20% by weight) of an inorganic filler, such as calcium carbonate, kaolin and white carbon has been carried out in the present industry. However, only if the inorganic filler is added in a large amount, the weight of paper increases remarkably. Even if the amount of pulp is reduced and the inorganic filler is added, it is impossible to make the paper light. In the case that the inorganic filler is added in particular to deinked pulp, a large amount of the inorganic filler is necessary. The lightening of the paper becomes increasingly difficult.

DISCLOSURE OF INVENTION

An object of the present invention is to solve the above-mentioned various problems associated with the lightening of paper and the increase in the amount of deinked pulp. Specifically, it is to provide a paper quality improver composition for papermaking, which can attain at least two of improvements in bulky value, brightness and opacity due to modifying a surface of pulp as well as which can improve a paper-strength.

The present invention provides a paper quality improver composition for papermaking; which comprises (A) a compound having a lyotropic degree, defined below, of not less than 4% and meeting at least two efficiencies selected from the following paper quality improving efficiencies (i) to (iii) and (B) a water-soluble polymer satisfying at least one selected from an average molecular weight of 1000 to 10000000 and a viscosity of 1 to 4000 mPa•s at 25° C. in a 1% aqueous solution thereof; which is internally added before or in papermaking step;

(i) standard improved bulky value of not less than 0.02 $g/cm^3$, (ii) standard improved brightness of not less than 0.5 point, and (iii) standard improved opacity of not less than 0.5 point; and lyotropic degree $(\%)=(\alpha_0-\alpha)/\alpha_0\times100$ wherein $\alpha$: the water content in a wet sheet obtained by adding 5 parts by weight of the compound which becomes the paper quality improver composition for the papermaking to 100 parts by weight of pulp and subjecting the resultant to the papermaking, and $\alpha_0$: the water content in a wet sheet obtained by subjecting pulp to the papermaking without adding the compound which becomes the paper quality improver composition for papermaking to the pulp.

The water-soluble polymer is a polymer compound from which an aqueous solution having a concentration of 0.1% or more by weight at 40° C. can be obtained. It includes a polymer compound from which an aqueous solution having a concentration of 0.1% or more by weight can be obtained by dissolving it in water at a temperature of higher than 40° C. and then cooling the solution.

The present invention provides also a process for producing a pulp sheet, which comprises adding the composition as defined above anytime before or in papermaking step. Further, the present invention provides a pulp sheet produced by adding the composition as defined above at anytime before or in papermaking step.

The following will describe methods for measuring the lyotropic degree, the standard improved bulky value, the standard improved brightness and the standard improved opacity according to the present invention, in detail.

[Method for Measuring the Lyotropic Degree]

(A) Pulp for Use

There is used a bleached hardwood pulp which is derived from a beech and whose Hunter's brightness (JIS P 8123) of a hand-made pulp sheet, prepared by the method for preparing hand-made paper for a pulp test according to JIS P 8209, is 80±5%. (This pulp is referred to as an LBKP hereinafter.)

(B) Measurement of the Lyotropic Degree

① A predetermined amount of an LBKP is disintegrated (brushed out) with a beater at 25±3° C. and then beaten into a Canadian standard freeness (JIS P 8121) of 460±10 ml so as to obtain an LBKP slurry whose pulp concentration is 1.0% by weight.

This pulp slurry is weighed out so that the basis weight of the LBKP of a sheet to be prepared by papermaking becomes 80±2 $g/m^2$. The pH thereof is then adjusted into 4.5 with aluminum sulfate, and subsequently 5 parts (net) by weight of an ethanol-solution of 1.0% by weight of a paper quality improver composition for papermaking is added as compared with 100 parts by weight of the pulp. The resultant is subjected to papermaking using a 150-mesh wire (area: 200 $cm^2$) in a circular TAPPI papermaking machine to obtain a wet sheet. Two filter papers having a basis weight of 320±20 $g/m^2$ (diameter: 185 mm) are stacked on the wet sheet, and further a coach plate is stacked thereon to perform coaching. Thereafter, the wet sheet is taken out. Next, the wet sheet is put between the above-mentioned two filter papers at upper-face and bottom-face therefrom and then is pressed at a pressure of 340±10 kPa for 5 minutes. After the press, the weight W (g) of the wet sheet is promptly measured.

Next, the wet sheet is dried at 105±3° C. for 60 minutes. A basis weight $W_d$ (g) of obtained dry sheet is measured.

② From the W and $W_d$ obtained as above, the water content α (%) is obtained by the formula (1):

$$\alpha(\%)=(W-W_d)/W\times 100 \quad (1).$$

Without adding any compound which becomes a paper quality improver composition for papermaking, a sheet is prepared in the same manner. The water content obtained in the same manner is represented by $\alpha_0$.

③ From the water contents α and $\alpha_0$ obtained as above, the lyotropic degree is obtained by the following formula (2):

$$\text{lyotropic degree } (\%)=(\alpha_0-\alpha)/\alpha_0\times 100 \quad (2).$$

[Method for Measuring the Standard Improved Bulky Value]

① A predetermined amount of an LBKP is brushed out with a beater at 25±3° C. and then beaten into a Canadian standard freeness (JIS P 8121) of 460±10 ml so as to obtain an LBKP slurry whose pulp concentration is 1.0% by weight.

This pulp slurry is weighed out so that the basis weight of the LBKP of a sheet to be prepared by papermaking becomes 80±0.5 $g/m^2$. The pH thereof is then adjusted into 4.5 with aluminum sulfate, and subsequently 0.5 parts (net) by weight of an ethanol-solution of 1.0% by weight of a paper quality improver composition for papermaking is added as compared with 100 parts by weight of the pulp. The resultant is subjected to papermaking using a 150-mesh wire (area: 200 $cm^2$) in a circular TAPPI paper machine to obtain a wet sheet. Two filter papers having a basis weight of 320±20 $g/m^2$ (diameter: 185 mm) is stacked on the wet sheet, and further a coach plate is stacked thereon to perform coaching. Thereafter, the wet sheet is taken out. Next, the wet sheet is put between the above-mentioned two filter papers at upper-face and bottom-face therefrom and then is pressed at a pressure of 340±10 kPa for 5 minutes. After the press, only the sheet is dried with a drum drier at 105±3° C. for 2 minutes. The moisture content in the dried sheet is regulated at a temperature of 20±1° C. and a humidity of 65±2% for 5 hours.

② The sheet having a regulated moisture content is weighed, and its basis weight ($g/m^2$) is obtained by the calculating formula (3) mentioned below:

$$\text{basis weight } (g/m^2)=\text{sheet weight}/0.02 \quad (3).$$

Next, a micrometer for paper is used to measure the thickness of 10 points of the sheet having the regulated moisture content at a pressure of 54±5 kPa. The average of the obtained measuring values is made up as thickness (mm).

③ From the basis weight and the thickness obtained as above, bulk density d ($g/cm^3$) is obtained by the following formula (4):

$$d=(\text{basis weight})/(\text{thickness})\times 0.001 \quad (4).$$

Without adding any compound which becomes a paper quality improver composition for papermaking, a sheet is prepared in the same manner. The bulk density obtained in the same manner is represented by $d_0$.

④ From the bulk densities d and $d_0$ obtained as above, the standard improved bulky value is obtained by the following formula (5):

$$\text{standard improved bulky value } (g/cm^3)=d_0-d \quad (5).$$

[Method for Measuring the Standard Improved Brightness]

① The same as ① about the method for measuring the standard improved bulky value.

② About a sheet having a regulated moisture content, its brightness B is measured according to Hunter's brightness in JIS P 8123. Without adding any compound which becomes a paper quality improver composition for papermaking, a sheet is prepared in the same manner. The brightness obtained in the same manner is represented by $B_0$.

③ From the brightness B and $B_0$ obtained as above, the standard improved brightness is obtained by the following formula (6):

$$\text{standard improved brightness (point)}=B-B_0 \quad (6)$$

[Method for Measuring the Standard Improved Opacity]

① The same as ① about the method for measuring the standard improved bulky value.

② About a sheet having a regulated moisture content, its opacity P is measured according to JIS P 8138A.

Without adding any compound which becomes a paper quality improver composition for papermaking, a sheet is prepared in the same manner. The opacity obtained in the same manner is represented by $P_0$.

③ From the opacities P and $P_0$ obtained as above, the standard improved opacity is obtained by the following formula (7):

$$\text{standard improved opacity (point)}=P-P_0 \quad (7).$$

As described above, an LBKP slurry of 1.0% by weight is prepared by the predetermined method: ① to measure the lyotropic degree under the condition that the slurry of 5% by weight as compared with pulp is added, and ② to measure the standard improved bulky value, the standard improved brightness and the standard improved opacity under the condition that the slurry of 0.5% by weight as compared with pulp is added. In this way, the paper quality improver composition for papermaking of the present invention is easily specified.

MODES FOR CARRYING OUT THE INVENTION

When (A) the compound having the lyotropic degree defined in the present invention of not less than 4% is added to pulp slurry to be fixed the pulp, the surface of the pulp is made hydrophobic. Therefore, the following can be considered: the interfacial tension between the pulp and the aqueous solution increases so that many voids are made between the pieces of the pulp during papermaking, thereby to obtain a bulky pulp sheet; and optical reflectance also becomes large to obtain a pulp sheet having improved brightness and opacity. The following can be also considered: even if only a part of the surface of the pulp is made hydrophobic so that the voids between the pieces of the pulp do not increase and high bulky value is less exhibited, for example, upon the addition of a small amount of the above-mentioned compound, the number of hydrogen bonds between the pieces of the pulp is reduced so that the surface area of the pulp increases, thereby optical reflectance increases to improve brightness and opacity. The brightness can be calculated from lightness (the L value) and the b value. The larger the L value becomes, the larger the brightness becomes. And the smaller the b value becomes, the larger the brightness becomes. It is considerable that the efficiency for improving the brightness according to the present invention is achieved by an increase in the L value. Hitherto, the relationship between one member as the hydrophobicity of the surface of pulp and another member as bulky value and optical properties has not been known. The present inventor has however found that the both members have a correlation. Moreover, the inventor has found that in the case of using a compound having the lyotropic degree defined above of not less than 4%, preferably not less than 5%, and using a water-soluble polymer having a specific property; a pulp sheet having improved bulk, brightness and opacity and having improved paper-strength can be obtained even by the addition of a small amount thereof. The pulp sheet is a general term including paper and paperboard described in JIS P 0001.

(A) The compound having lyotropic degree defined in the present invention of not less than 4% satisfies any two or more selected from the followings (i) to (iii) defined in the present invention: (i) the standard improved bulky value is 0.02 g/cm$^3$ or more, preferably 0.025 g/cm$^3$ or more and more preferably 0.03 g/cm$^3$ or more; (ii) the standard brightness is 0.5 point or more, preferably 0.7 point or more and more preferably 0.9 point or more; and (iii) the standard improved opacity is 0.5 point or more, preferably 0.7 point or more and more preferably 0.9 point or more. The composition satisfying the three of the (i) to (iii) is more preferable.

In the present invention, (A) the compound having the lyotropic degree of not less than 4% is preferably an organic compound which has a hydrophilic group for adhering onto a pulp surface and a hydrophobic group for making the pulp surface hydrophobic. The compound (A) can be selected from the group consisting of (A1) organosiloxane, (A2) glyceryl ether, (A3) amide, (A4) amine, (A5) an acid salt of amine, (A6) a quaternary ammonium salt, (A7) an imidazol compound, (A8) an ester of a polyhydric alcohol and a fatty acid, and (A9) an alkylene oxide-added ester being an ester derived from a polyhydric alcohol and a fatty acid and having from more than zero mole to less than 12 moles on the average of $C_{2-4}$ alkylene oxide group per 1 mole of the ester.

(A1) The organosiloxane may be exemplified as a methylpolysiloxane having a viscosity of 10 to 1,000,000 mPa·s at 25° C., a polyoxy ethylene methylpolysiloxane copolymer having HLB of 1 to 14 by Griffin's method, a poly (oxyethylene. oxypropylene)methylpolysiloxane copolymer having HLB of 1 to 14 thereby.

(A2) The glyceryl ether may be a compound represented by the following formula (a):

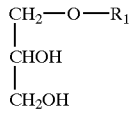

(a)

wherein $R_1$ is an alkyl, alkenyl or β-hydroxyalkyl group having 8 to 35 carbon atoms.

(A3) The amide, (A4) the amine, (A5) the acid salt of amine, (A6) the quaternary ammonium salt, (A7) the imidazol may be a compound represented by the following formula (b) to (j). The acid salt of amine may include ionized or non-ionized one.

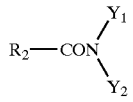

(b)

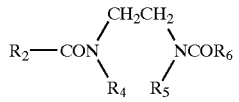

(c)

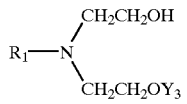

(d)

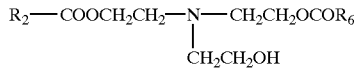

(e)

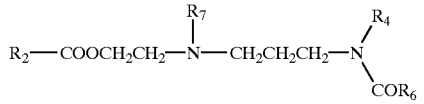

(f)

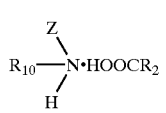

(g)

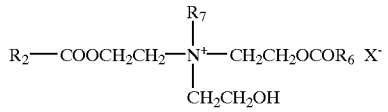

(h)

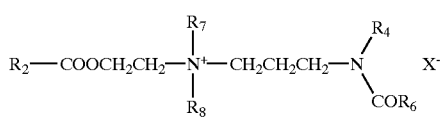

(i)

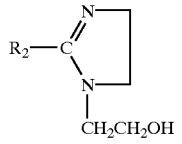

(j)

wherein $Y_1$ and $Y_2$ are same as or different from each other and represent a hydrogen atom, $R_4$, $R_6CO$—, —$(AO)_n$—$COR_3$ or —$(AO)_n$—H;

AO represents an alkylene oxide having 2 to 4 carbon atoms; and $Y_3$ represents a hydrogen atom or —$COR_6$;

Z represents

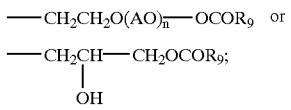

$R_1$ is the same as in the above-mentioned formula (a); each of $R_2$, $R_3$, $R_6$ and $R_9$ represents an alkyl, alkenyl or β-hydroxyalkyl group having 7 to 35 carbon atoms;

each of $R_4$ and $R_5$ represents a hydrogen atom or an alkyl group having 1 to 3 carbon atoms;

each of $R_7$ and $R_8$ represents an alkyl group having 1 to 3 carbon atoms;

$R_{10}$ represents a hydrogen atom or $R_9$;

n is an average number of added moles of 1 to 20; and $X^-$ represents an anionic ion.

The polyhydric alcohol which composes a compound of (A8) or (A9) is preferably a 2- to 14-hydric alcohol which may have an ether group and wherein the total number of carbon atoms is 2 to 24; more preferably a 2- to 8-hydric alcohol; and particularly preferably a 3- to 6-hydric alcohol. The dihydric alcohol may be exemplified as an alcohol which may have an ether group and wherein the total number of carbon atoms is 2 to 10. For example, it is propylene glycol, dipropylene glycol, butylene glycol, dibutylene glycol, ethylene glycol, diethylene glycol or polyethylene glycol. The tri- or more-hydric alcohol may be exemplified as an alcohol which may have an ether group, wherein the total number of carbon atoms is 3 to 24 and wherein the total number of hydroxyl groups/the total number of carbon atoms in one molecule is 0.4 to 1. For example, it is glycerol, polyglycerol (average condensation degree: 2 to 5), pentaerythritol, dipentaerythritol, arabitol, sorbitol, stachyose, erythrite, mannite, glucose or sucrose. There may be more preferable ethylene glycol, diethylene glycol, polyethylene glycol or a tri- or more-hydric alcohol which may have an ether group, wherein the total number of carbon atoms is 3 to 12 and wherein the total number of hydroxyl groups/the total number of carbon atoms in one molecule is 0.5 to 1. There maybe particularly preferable glycerol, polyglycerol (average condensation degree: 2 to 4) or pentaerythritol.

The fatty acid which composes one of these esters may be a fatty acid which has 1 to 24 carbon atoms and preferably has 10 to 22 carbon atoms. It may be a saturated or unsaturated and may be a linear or branched one. There is particularly preferable a straight chain fatty acid. There is more preferable lauric acid, myristic acid, palmitic acid, stearic acid, behenic acid or oleic acid. Stearic acid is preferable in particular.

This ester can be obtained by carrying out a publicly known esterifying reaction and alkylene oxide addition reaction. For example, a mixture of the fatty acid and the polyhydric alcohol is, if necessary an esterifying catalyst is added thereto, reacted at 150 to 250° C. to obtain an ester. Further, an alkylene oxide having 2 to 4 carbon atoms is added thereto in the presence of an alkali catalyst or the like, to obtain the alkylene oxide-added ester. On the other hand, an alkylene oxide may be added to the fatty acid or the polyhydric alcohol to be esterified. In some case, the ester can be obtained by only adding an alkylene oxide to the fatty acid.

About the average esterification degree of this ester, the OH groups of 1 mole of polyhydric alcohol are preferably substituted in a 10 to 95% equivalent. There is particularly preferable to have an ester group of 1 to 2 moles per mole of polyhydric alcohol.

When the alkylene oxide-added ester is used, the number of added moles of alkylene oxide (referred to as AO hereinafter) is on average from more than 0 mole to less than 12 moles, preferably from 0.1 to 6 moles, per mole of an ester. When a polyhydric alcohol, which can become an AO group, such as ethylene glycol, is used, the mole numbers thereof are also counted as the number of AO groups. The AO is preferably ethylene oxide (referred to as EO hereinafter) or propylene oxide (referred to as PO hereinafter). It is allowable to use EO or PO alone, or to use a mixture of EO and PO. In the present invention, it is particularly preferable to use the ester of the polyhydric alcohol comprising no AO group with the fatty acid.

The water-soluble polymer (B) used in the paper quality improver composition for papermaking of the present invention satisfies at least either an average molecular weight of 1000 to 10000000 or a viscosity of a 1% aqueous solution of 1 to 4000 mPa·s at 25° C. When the average molecular weight or the viscosity is within the above-mentioned range, it is excellent in a paper-strength effect. Then, the water-soluble polymer (B) has also an improved effect for emulsifying and/or dispersing performance of the compound (A). A preferable water-soluble polymer (B) satisfies at least either an average molecular weight of 20000 to 6000000 or a viscosity of a 1% aqueous solution of 1 to 1000 mPa·s at 25° C.

Then, the average molecular weight of the water-soluble polymer (B) and the viscosity of the 1% aqueous solution thereof are measured by the following methods.

Method of Measuring the Average Molecular Weight

The 1% aqueous solution (by weight) of the water-soluble polymer was prepared and measured by GPC with the following conditions. The molecular weight was calculated by using pullulan.

[Condition for the Measurement]

Column: α–M×2 (Tosoh Corp.)

Eluent: 0.15M $Na_2SO_4$/1% acetic acid

Flow-rate: 1 mL/min

Temperature of Column: 40° C.

Detector: RI

Concentration of sample: 5 mg/mL

Amount for feeding: 100 μL

<Method of Measuring the Viscosity>

A 1% aqueous solution of the water-soluble polymer by weight was prepared and measured with a Brookfield viscometer (provided by TOKIMEC INC.) at 25° C. The number of revolution was 60 rpm(r/min), No. 1 rotor was used for not more than 80 mPa·s, No. 2, for more than 80 mPa·s to not more than 400 mPa·s, No. 3 rotor, for more than 400 mPa·s to not more than 1600 mPa·s or No. 4 rotor, more than 1600 mPa·s to not more than 8000 mPa·s in proportion to the viscosity.

The water-soluble polymer (B) may be a polyvinylalcohol-based polymer, a polyacrylamide-based polymer, a polyethyleneimine, an urea-formaldehyde resin, a melamine-formaldehyde resin, a epoxidized polyamide resin, a carboxymethyl cellulose, a starch, a denatured (or modified) starch, a gum oleoresin or the like. In particular, preferable is at least one compound selected from the group consisting of (B-1) a polyacrylamide-based polymer(s), (B-2) a polyvinylalcohol-based polymer(s), (B-3) a starch(s) and/or denatured starch(s) and (B-4) a gum oleoresin(s).

For example, the starch (B-3) may be a natural starch such as (B3-1) a corn starch, (B3-2) a potato starch, (B3-3) a wheat starch, (B3-4) a tapioca starch, (B3-5) an oxidized starch and (B3-6) a cationic starch. The denatured starch (B3) is a modified starch prepared by treating a starch physically and/or chemically, written in Page 36 to 37 of "Kamito Kakono Yakuhinjiten (translation: Dictionary for Chemicals in Paper and Process)" (published by TecTimes, 1991). It is preferably, for example, an oxidized starch treated by an oxidant such as sodium hypochlorite and periodate or, for example and a cationic starch into whose molecule is introduced a cationic group such as hydrochloric acid salt of 3-chloro-2-hydroxypropyltrimethylammonium chloride, glycidyltrimethylammonium chloride or diethylaminoethyl chloride. As shown in Page 283 of "Dictionary for Chemicals in Paper and Process", a denatured starch prepared by further introducing a phosphate group into the above-mentioned cationic starch may be called an amphoteric starch. In the present invention, the cationic starch includes this amphoteric starch.

In particular, it is more preferable that the cationic starch is used because of being able to attain an improvement of a paper-strength without damaging the bulky improving efficiency even if an added amount thereof is increased. In addition, a substitution degree with cation(s) is preferably 0.005 to 0.1 and more preferably 0.01 to 0.08 in the cationic starch. The substitution degree with cation(s) in the cationic starch represents the average number of hydroxy groups substituted by cationic groups among all the hydroxy groups included in a glucose residue constituting a cationic starch. When they are introduced into all the hydroxy groups, the degree is 3.

In the paper quality improver composition for papermaking of the present invention, the ratio by weight of the compound (A) to the water-soluble polymer (B), namely (A)/(B), is preferably 99.999/0.001 to 20/80, more preferably 95/5 to 30/70 and most preferably 95/5 to 50/50.

Then, the paper quality improver composition for papermaking of the present invention contains preferably at least one surfactant (C). The surfactant (C) maybe a nonionic, anionic, cationic or amphoteric surfactant. The surfactant (C) is preferably an anionic or cationic surfactant and more preferably the following one.

(C1) Salts of Higher Fatty Acids

For example, sodium, potassium and ammonium salts of stearic acid, oleic acid, palmitic acid, myristic acid, lauric acid, rhodinic acid, tall oil fatty acid.

(C2) Salts of Sulfate of Higher Alcohols

For example, sodium, potassium and ammonium salts of lauryl sulfate, myristyl sulfate, palmityl sulfate, stearyl sulfate and oleyl sulfate.

(C3) Salts of Alkylbenezene Sulfonic Acid

For example, sodium salt of linear dodecylbenzene sulfonic acid and sodium salt of branched dodecylbenzene sulfonic acid.

(C4) Salts of Sulfosuccinic Acid Diester

For example, sodium salt of di-2-ethylhexyl sulfosuccinate, sodium salt of diisotridecyl sulfosuccinate and sulfosuccinic acid dicyclohexyl sulfosuccinic acid.

(C5) A Condensate of Naphthalene Sulfonic Salt with Formaldehyde (C6) Salts of a Polycarbonic Acid For example, sodium, potassium, calcium and ammonium salts of polyacrylic acid, polymethacrylic acid and polymaleic acid; or sodium, potassium, calcium and ammonium salts of a copolymer derived from two or more selected from the group consisting of acrylic aid, methacrylic acid, maleic acid and styrene.

(C7) Quaternary Ammonium Salts

Lauryltrimethylammonium chloride, cetyltrimethylammonium chloride, stearyltrimethylammonium chloride, distearyldimethylammonium chloride and the like.

When the surfactant (C) is combined with the water-soluble polymer (B), emulsification and/or dispersion of the compound (A) can be further improved, a separation, gelation or the like thereof by a storage for a long term can be suppressed. That is, the paper quality improver composition for papermaking of the present invention has a good emulsification-stability for 1 day or more by combination of the components (A) and (B), but it has a remarkably improved emulsification-stability by the component (C) combined further therewith so that a handling-property thereof is excellent.

When the paper quality improver composition for papermaking of the present invention contains a surfactant, the ratio of the compound (A), the water-soluble polymer (B) and the surfactant (C) by weight is preferably that [the compound (A)+the water-soluble polymer (B)]/the surfactant (C) is 99.999/0.001 to 70/30 and more preferably that it is 99.9/0.01 to 80/20.

The paper quality improver composition for papermaking of the present invention may be added to the papermaking step after emulsifying and/or dispersing the compound (A) in the water-soluble polymer (B) or a mixture of the water-soluble polymer (B) and the surfactant (C). Alternatively, the compound (A) and the water-soluble polymer (B) may be added separately from each other to the papermaking step.

The emulsification and/or dispersion of the compound (A) by the water-soluble polymer (B) or the mixture of the water-soluble polymer (B) and the surfactant (C) can be carried out by using a generally conducted recipe for an emulsification and/or dispersion, depending on the used compound (A), water-soluble polymer (B) or surfactant (C). For example, it may be a phase-conversional emulsification or a mechanical emulsification using a homogenizing mixer, a high-pressure homogenizer, a colloid mill or the like. If bubbles are generated in emulsification and/or dispersion, a proper amount of a defoaming agent may be added thereto.

The paper quality improver composition for papermaking of the present invention is added anytime in the papermaking step. The composition may be added as it is or optionally added by diluting it in water or the like.

The paper quality improver composition for papermaking of the present invention is widely applicable to pulp feedstocks such as virgin pulps of mechanical pulps such as a thermomechanical pulp (TMP), and chemical pulps such as an LBKP; and pulps prepared from waste papers. When the deinked pulp is blended, the blended amount thereof is preferably 10% or more by weight, and more preferably 30% or more by weight, of the pulp feedstock.

The paper quality improver composition for papermaking of the present invention is added anytime before or in papermaking step (internal addition). Before or in papermaking step to form paper layers by draining water from a diluted liquid of a pulp feedstock throughout the advance thereof on a wire netting; the paper quality improver composition for papermaking may be added, as added spot thereof, into a disintegrator such as a pulper or a refiner or a beater; a tank such as a machine chest, a headbox, a white water tank; or a laying pipe connected to these facilities. A spot where a pulp feedstock can be uniformly blended, such as the refiner, the machine chest or the headbox is desirable as the added spot. It is preferable that the paper quality improver composition for papermaking of the present invention is added to a pulp feedstock and subsequently the resultant is, as it is, subjected to papermaking so that the majority of the composition remains in the resultant pulp sheet.

At the time of papermaking, it is allowable to add a sizing agent, a filler, a retention agent, a drainage aid, a paper-strength additive, and the like. In particular, in order to exhibit the function of the paper quality improver composition for papermaking of the present invention, it is important that the composition is fixed onto pulp. For this, an agent for promoting to fix is preferably added. The agent for promoting to fix is aluminum sulfate, a compound having an acrylamide group, polyethylene imine, and the like. The added amount of the agent for promoting to fix is preferably from 0.01 to 5 parts by weight per 100 parts by weight of a pulp feedstock.

The paper quality improver composition for papermaking of the present invention is preferably added in an amount of 0.01 to 5 parts by weight per 100 parts by weight of pulp feedstock. In particular, even if it is added in a small amount of 0.1 to 2 parts by weight, at least two of bulky value and, brightness and opacity are improved as well as the paper-strength is also improved.

The compound which becomes the paper quality improver composition for papermaking of the present invention can be used as a bulky value improver for papermaking, a brightness improver for papermaking, and an opacity improver for papermaking.

Concerning the preferable pulp sheet obtained using the paper quality improver composition for papermaking of the present invention, its bulk density being an index of bulky value is not less than 0.02 g/cm$^3$ and preferably not less than 0.03 g/cm$^3$ lower than that of an additive-free sheet, its brightness is not less than 0.5 point and preferably not less than 0.7 point higher than that of an additive-free sheet, and its opacity is not less than 0.5 point and preferably not less than 0.7 point higher than that of an additive-free sheet. It is preferable that its paper-strength is not less than 105 and preferably 110 when the paper-strength is 100 using solely the compound (A).

Further, the pulp sheet obtained using the paper quality improver composition for papermaking of the present invention can be suitably used for paper such as a newsprint, printing paper, information business paper, wrapping paper, or paperboard in the category list which is mentioned in Page 455 to 460 of "Handbook of the paper pulp craft" (issued by Kami Pulp Gijyutsu Kyokai, 1992).

ADVANTAGEOUS EFFECT OF THE INVENTION

According to the present invention, there is provided a paper quality improver composition for papermaking which achieves at least two of improvements in bulky value, brightness, opacity and the like being desirable at lightening of paper and at increasing a blending amount of deinked pulp and which can improve a paper-strength, even if small amount of the paper quality improver composition for papermaking is added thereto. Further, according to the paper quality improver composition for papermaking of the present invention, it is also possible to obtain a pulp sheet having an improved bulky value, brightness and opacity and having an improved paper-strength.

EXAMPLES

In the followings, "parts" and "%" are parts by weight and % by weight, respectively, unless otherwise indicated.

Examples for Production (1) Blending Components

Table 1 shows the compounds (A), their lyotropic degrees, their standard improved bulky values, their standard improved brightnesses, and their standard improved opacity. Measuring the lyotropic degrees, a filter paper No. 26 (diameter: 185 mm, and basis weight: 320 g/m$^2$), provided by Advantec Toyo Co., Ltd., was used. Table 2 shows the waters-soluble polymers (B) and their average molecular weights or viscosity of their 1% aqueous solutions. Table 3 shows the surfactants (C). Then, the aqueous solutions were obtained at not less than 1% by weight in water at 40° C. from all of the water-soluble polymers B-1 to B-14.

TABLE 1

| Compound No. | Name of compounds | Lyotropic degree (%) | Standard improved bulky value (g/cm$^3$) | Standard improved brightness point | Standard improved opacity point |
|---|---|---|---|---|---|
| A-1 | Methylpolysiloxane (Shin-Etsu silicone KF96A-1000) | 5.9 | 0.025 | 1.0 | 0.9 |
| A-2 | Glycerol monolauryl ether | 6.6 | 0.028 | 1.5 | 1.1 |
| A-3 | Stearic acid monoglyceride | 5.7 | 0.026 | 1.5 | 1.0 |
| A-4 | Pentaerythritol stearate (average degree of transesterification being 45 eguivalent-%) | 5.2 | 0.028 | 1.4 | 1.6 |
| A-5 | Sorbitan sesquioleate | 5.4 | 0.023 | 1.3 | 1.4 |
| A-6 | Adduct to lauric acid monoglyceride with 0.4 mole of PO | 6.0 | 0.022 | 1.0 | 0.9 |

TABLE 2

| Water-soluble polymer No. | Name of the water-soluble polymer | Average molecular weight | Viscosity of the 1% aqueous solution (25° C., mPa · s) |
|---|---|---|---|
| B-1 | Partially saponified product of polyvinyl alcohol (Nippon Synthetic Chemical Industry, Co., Ltd., GOHSENOL GL-03) | 14000 | — |
| B-2 | Polyvinyl alcohol (Kuraray Co., Ltd., PVA 105) | 22000 | — |

TABLE 2-continued

| Water-soluble polymer No. | Name of the water-soluble polymer | Average molecular weight | Viscosity of the 1% aqueous solution (25° C., mPa · s) |
|---|---|---|---|
| B-3 | Partially saponified product of polyvinyl alcohol (Kuraray Co., Ltd., PVA 220) | 98000 | — |
| B-4 | Amphoteric polyacrylamide (Kao Corp., Mytend C-5) | 4000000 | — |
| B-5 | Oxidized starch (Oji Corn Starch Co., Ltd., Ace A) | — | 2.3 |
| B-6 | Cationic starch (Degree of substitution: 0.02) (Nippon NSC Ltd., CATO 302) | — | 266 |
| B-7 | Cyamoposis gum (Sansho, MEYPRO-GUAR CSAA) | — | 3000 |
| B-8 | Cationic starch (Degree of substitution: 0.03) (Oji Corn Starch Co., Ltd., Ace K 504) | — | 14 |
| B-9 | Cationic starch (Degree of substitution: 0.02) (Oji Corn Starch Co., Ltd.,, Ace K 250) | — | 2 |
| B-10 | Cationic starch (Degree of substitution: 0.04) (Oji Corn Starch Co., Ltd., Ryosei KH 1000) | — | 53 |
| B-11 | Cationic starch (Degree of substitution: 0.04) (Nippon Shokuhin Kako Co., Ltd., Neotac 40 T) | — | 65 |
| B-12 | Cationic starch (Degree of substitution: 0.04) (Nippon NSC Ltd., CATO 308) | — | 151 |
| B-13 | Cationic starch (Degree of substitution: 0.03) (Nihon Corn Starch, V 3035) | — | 39 |
| B-14 | Corn starch (Wako Pure Chemical Industries, Ltd., Reagent) | — | 850 |

TABLE 3

| Surfactant No. | Surfactant |
|---|---|
| C-1 | Sodium dodecylbenzenesulfonate |
| C-2 | Cetyltrimethylammonium chloride |
| C-3 | Sodium salt of copolymer of styrene/maleic acid (molar ratio: 1/1) (average molecular weight: 1800) |

(2) Production of the Paper Quality Improver Composition for Papermaking

The paper quality improver compositions for papermaking, which are shown in Tables 4 to 6, were produced from the above-mentioned components by the following producing method. That is, a mixture of the component (A) and the water-soluble polymer (B) or another mixture of the component (A), the water-soluble polymer (B) and the surfactant (C) was homogeneously added to a warm water at 70° C. in a 2 L beaker, then stirred homogeneously at 70° C. and passed once through by a high-pressure homogenizer (HV-OH-1-2.2S type provided by Izumi Food Machinery) with 200 kg/cm$^2$ (20 MPa) and emulsified to obtain a 5% (a total amount of the components (A), (B) and (C)) emulsified/dispersed liquid.

EXAMPLES

[Pulp Feedstocks]

A deinked pulp and a virgin pulp shown below were used as pulp feedstocks.

Deinked Pulp

A deinked pulp was obtained in the following manner. To 100 parts of feedstock wastepaper collected in the city (newspaper/leaflet=70/30%) were added warm water of 60° C., 1 part of sodium hydroxide, 3 parts of sodium silicate, 3 parts of a 30% aqueous hydrogen peroxide solution, and 0.3 part of EO PO (average number of moles added: EO=70 moles and PO=10 moles) block adduct of beef tallow/glycerol (weight ratio=1:1) as a deinking agent. The feedstock was disintegrated and then subjected to flotation. The resultant slurry was washed with water and regulated to a concentration of 1% to prepare a deinked pulp slurry. The Canadian standard freeness (JIS P 8121) of the deinked pulp slurry was 220 mL.

<Virgin Pulp 1>

Chemical pulp LBKP (bleached hardwood pulp) was disintegrated and beaten with a beater at 25° C. to give a 2% LBKP slurry and the resultant slurry was used as the virgin pulp 1. The Canadian standard freeness (JIS P 8121) of the resultant slurry was 440 ml.

<Virgin Pulp 2>

Mechanical pulp TMP mat (Canadian standard freeness (JIS P 8121) of 90 ml) was disintegrated with a pulper at 90° C. to give a 2% TMP slurry and the resultant slurry was used as the virgin pulp 2.

[Papermaking Method-1]

The deinked pulp slurry was weighed out in such an amount that a sheet after papermaking has a pulp of basis weight of 60 g/m$^2$. The pH thereof was adjusted to 4.5 with aluminum sulfate. Subsequently, 0.5 part, as en effective amount of the compound (A), of each of various paper quality improver compositions for papermaking shown in Tables 4 to 6 was added to 100 parts of the pulp. Each resultant mixture was formed into a sheet with a circular TAPPI papermaking machine using an 80-mesh wire (area: 200 cm$^2$). The sheet obtained was pressed with a press machine at 340 kPa for 2 minutes and dried with a drum dryer at 105° C. for 1 minute. After each of dried sheets was held under the condition of 20° C. and a humidity of 65% for 1 day to regulate its moisture content; the bulk density, the brightness, the opacity and the bursting strength of the sheet were measured in the following manner. Each of the measured values was the average of 10 measured values. The results obtained are shown in Tables 4 to 6.

[Papermaking Method-2]

LBKP was weighed out in such an amount that a sheet after papermaking has a pulp of basis weight of 80 g/m$^2$. The pH thereof was adjusted to 4.5 with aluminum sulfate. Subsequently, 0.5 part, as en effective amount of the compound (A), of each of various paper quality improver compositions for papermaking shown in Tables 4 to 6 was added to 100 parts of the pulp. Each resultant mixture was formed into a sheet with a circular TAPPI papermaking machine using a 150-mesh wire (area: 200 cm$^2$). The sheet obtained was pressed with a press machine at 340 kPa for 5 minutes and dried with a drum dryer at 105° C. for 2 minutes. Then, evaluations were carried out by the same manner as in Papermaking method-1. The results are shown in Tables 4 to 6.

[Papermaking Method-3]

TMP was weighed out in such an amount that a sheet after papermaking has a pulp of basis weight of 50 g/m$^2$. The pH thereof was adjusted to 4.5 with aluminum sulfate. Subsequently, 0.7 part, as en effective amount of the compound (A), of each of various paper quality improver compositions for papermaking shown in Table 7 was added to 100 parts of the pulp. Each resultant mixture was formed into a sheet with a circular TAPPI papermaking machine using an 80-mesh wire (area: 200 $cm^2$). The sheet obtained was pressed with a press machine at 340 kPa for 5 minutes and dried with a drum dryer at 105° C. for 2 minutes. Then, evaluations were carried out by the same manner as in Papermaking method-1. The results are shown in Table 7.

<Evaluation Items and Methods>

Bulk Density

The basis weight ($g/m^2$) and thickness (mm) of each of the sheets having a regulated moisture content were measured, and its bulk density ($g/cm^3$) was determined from the following Equation for calculation:

$$\text{Bulk density}=(\text{basis weight})/(\text{thickness})\times 0.001.$$

The smaller the bulk density is, the higher the bulky value is. A difference of 0.02 in the bulk density is sufficiently recognized as a significant difference.

Brightness

This is according to Hunter's brightness defined in JIS P 8123. A difference of 0.5 point in the brightness is sufficiently recognized as a significant difference.

Opacity

This is according to JIS P 8138A. A difference of 0.5point in the opacity is sufficiently recognized as a significant difference.

Bursting Strength

As an item for evaluating a paper-strength, bursting strength was measured by a method defined in JIS P 8112. When only the compound (A) was used, the paper-strength was 100, therefore 105 or more was sufficiently recognized as a significant difference.

Emulsification-Stability

A 5% (as a total amount of the components (A), (B) and (C)) emulsified/dispersed liquid obtained in the above-mentioned method was fed into a glass tube having 2 cm in diameter and 30 cm in height to occupy up to 20 cm in the height. The glass tube was placed in a constant temperature bath at 20° C. to evaluate emulsification-stability.

If separation happened within a day from starting the test, X is marked; if separation didn't happen for a day or more, ○ is marked; and if separation didn't happen for a month or more, ◎ is marked. Hereinafter, "separation" means that an interface of an emulsion/dispersion phase and a water phase has been generated from the emulsified/dispersed liquid in the glass tube at 5 mm or more from the liquid surface or the liquid bottom.

TABLE 4

| Paper quality improver composition No. | | Blended component | | | Ratio by weight | | |
|---|---|---|---|---|---|---|---|
| | | Compound (A) | Water-soluble polymer (B) | Surfactant (C) | Compound (A) | Water soluble polymer (B) | Surfactant (C) |
| Inventive product | 1 | A-1 | B-4 | — | 70 | 30 | 0 |
| | 2 | A-2 | B-4 | — | 70 | 30 | 0 |
| | 3 | A-3 | B-4 | — | 70 | 30 | 0 |
| | 4 | A-4 | B-4 | — | 70 | 30 | 0 |
| | 5 | A-5 | B-4 | — | 70 | 30 | 0 |
| | 6 | A-6 | B-4 | — | 70 | 30 | 0 |
| Comparative product | 1 | A-1 | — | — | 100 | 0 | 0 |
| | 2 | A-2 | — | — | 100 | 0 | 0 |
| | 3 | A-3 | — | — | 100 | 0 | 0 |
| | 4 | A-4 | — | — | 100 | 0 | 0 |
| | 5 | A-5 | — | — | 100 | 0 | 0 |
| | 6 | A-6 | — | — | 100 | 0 | 0 |
| | 7 | — | — | — | 0 | 0 | 0 |

| Paper quality improver composition No. | | Deinked pulp | | | | LBKP | | | |
|---|---|---|---|---|---|---|---|---|---|
| | | Bulk Density ($g/cm^3$) | Brightness (point) | Opacity (point) | Bursting strength (kPa) | Bulk Density ($g/cm^3$) | Brightness (point) | Opacity (point) | Bursting strength (kPa) |
| Inventive product | 1 | 0.340 | 54.2 | 91.6 | 167 | 0.597 | 89.0 | 87.0 | 179 |
| | 2 | 0.325 | 55.1 | 92.2 | 165 | 0.584 | 89.7 | 87.8 | 176 |
| | 3 | 0.328 | 55.0 | 92.4 | 164 | 0.587 | 89.5 | 87.6 | 173 |
| | 4 | 0.324 | 56.0 | 92.7 | 163 | 0.582 | 89.9 | 88.0 | 172 |
| | 5 | 0.334 | 54.7 | 91.9 | 162 | 0.593 | 89.2 | 87.3 | 172 |
| | 6 | 0.330 | 54.8 | 91.9 | 163 | 0.589 | 89.5 | 87.8 | 173 |
| Comparative product | 1 | 0.355 | 53.5 | 90.9 | 132 | 0.612 | 88.5 | 86.5 | 129 |
| | 2 | 0.340 | 54.4 | 91.5 | 128 | 0.598 | 89.3 | 87.2 | 126 |
| | 3 | 0.343 | 54.3 | 91.7 | 129 | 0.602 | 89.0 | 87.0 | 127 |
| | 4 | 0.339 | 55.3 | 92.0 | 128 | 0.597 | 89.5 | 87.3 | 124 |
| | 5 | 0.349 | 54.0 | 91.2 | 129 | 0.608 | 88.7 | 86.7 | 128 |
| | 6 | 0.345 | 54.1 | 91.2 | 130 | 0.604 | 89.0 | 87.1 | 128 |
| | 7 | 0.376 | 52.8 | 90.3 | 167 | 0.637 | 87.9 | 84.6 | 177 |

TABLE 5

| Paper quality improver composition No. | | Blended component: Compound (A) | Blended component: Water-soluble polymer (B) | Blended component: Surfactant (C) | Ratio by weight: Compound (A) | Ratio by weight: Water soluble polymer (B) | Ratio by weight: Surfactant (C) |
|---|---|---|---|---|---|---|---|
| Inventive product | 7 | A-4 | B-4 | — | 25 | 75 | 0 |
| | 8 | A-4 | B-1 | — | 70 | 30 | 0 |
| | 9 | A-4 | B-2 | — | 70 | 30 | 0 |
| | 10 | A-4 | B-3 | — | 70 | 30 | 0 |
| | 11 | A-4 | B-5 | — | 70 | 30 | 0 |
| | 12 | A-4 | B-6 | — | 70 | 30 | 0 |
| | 13 | A-4 | B-7 | — | 70 | 30 | 0 |

| Paper quality improver composition No. | | Deinked pulp: Bulk Density ($g/cm^3$) | Deinked pulp: Brightness (point) | Deinked pulp: Opacity (point) | Deinked pulp: Bursting strength (kPa) | LBKP: Bulk Density ($g/cm^3$) | LBKP: Brightness (point) | LBKP: Opacity (point) | LBKP: Bursting strength (kPa) |
|---|---|---|---|---|---|---|---|---|---|
| Inventive product | 7 | 0.336 | 55.5 | 92.2 | 215 | 0.593 | 89.6 | 87.5 | 231 |
| | 8 | 0.324 | 56.0 | 92.7 | 142 | 0.581 | 89.8 | 87.9 | 140 |
| | 9 | 0.325 | 55.9 | 92.6 | 156 | 0.581 | 89.8 | 88.0 | 166 |
| | 10 | 0.324 | 55.9 | 92.7 | 160 | 0.582 | 89.9 | 87.9 | 170 |
| | 11 | 0.324 | 56.0 | 92.7 | 141 | 0.581 | 89.8 | 87.9 | 138 |
| | 12 | 0.325 | 55.9 | 92.6 | 158 | 0.583 | 89.7 | 87.8 | 168 |
| | 13 | 0.341 | 55.4 | 92.1 | 168 | 0.595 | 89.5 | 87.4 | 177 |

TABLE 6

| Paper quality improver composition No. | | Blended component: Compound (A) | Blended component: Water-soluble polymer (B) | Blended component: Surfactant (C) | Ratio by weight: Compound (A) | Ratio by weight: Water soluble polymer (B) | Ratio by weight: Surfactant (C) |
|---|---|---|---|---|---|---|---|
| Inventive product | 14 | A-4 | B-4 | C-1 | 69.86 | 29.94 | 0.2 |
| | 15 | A-4 | B-4 | C-2 | 69.86 | 29.94 | 0.2 |
| | 16 | A-4 | B-4 | C-3 | 69.86 | 29.94 | 0.2 |
| | 17 | A-4 | B-4 | C-1 | 69.97 | 29.99 | 0.04 |
| | 18 | A-4 | B-4 | C-1 | 52.5 | 22.5 | 25 |
| | 19 | A-4 | B-4 | C-1 | 70 | 30 | 0.0005 |
| | 20 | A-4 | B-4 | C-1 | 28 | 12 | 60 |
| | 4 | A-4 | B-4 | — | 70 | 30 | 0 |
| Comparative product | 4 | A-4 | — | — | 100 | 0 | 0 |

| Paper quality improver composition No. | | Deinked pulp: Bulk Density ($g/cm^3$) | Deinked pulp: Brightness (point) | Deinked pulp: Opacity (point) | Deinked pulp: Bursting strength (kPa) | LBKP: Bulk Density ($g/cm^3$) | LBKP: Brightness (point) | LBKP: Opacity (point) | LBKP: Bursting strength (kPa) | Emulsification-stability |
|---|---|---|---|---|---|---|---|---|---|---|
| Inventive product | 14 | 0.323 | 56.1 | 92.7 | 164 | 0.581 | 90.0 | 88.1 | 173 | ◎ |
| | 15 | 0.322 | 56.2 | 92.8 | 160 | 0.579 | 90.0 | 88.2 | 169 | ◎ |
| | 16 | 0.324 | 56.0 | 92.7 | 164 | 0.581 | 89.9 | 88.1 | 173 | ◎ |
| | 17 | 0.323 | 56.0 | 92.7 | 164 | 0.578 | 90.0 | 88.1 | 172 | ◎ |
| | 18 | 0.324 | 56.0 | 92.7 | 163 | 0.579 | 89.9 | 88.0 | 171 | ◎ |
| | 19 | 0.324 | 56.1 | 92.7 | 161 | 0.581 | 90.0 | 88.0 | 171 | ○ |
| | 20 | 0.325 | 55.9 | 92.6 | 160 | 0.583 | 89.8 | 87.9 | 170 | ○ |
| | 4 | 0.324 | 56.0 | 92.7 | 163 | 0.582 | 89.9 | 88.0 | 172 | ○ |
| Comparative product | 4 | 0.339 | 53.3 | 92.0 | 128 | 0.597 | 89.5 | 87.3 | 124 | X |

TABLE 7

| Paper quality improver composition | No. | Blended component: Compound A | Blended component: Water-soluble polymer (B) | Blended component: Surfactant (C) | Ratio by weight: Compound (A) | Ratio by weight: Water-soluble polymer (B) | Ratio by weight: Surfactant (C) | TMP: Bulk density (g/cm$^3$) | TMP: Brightness (point) | TMP: Opacity (point) | TMP: Bursting strength (kPa) |
|---|---|---|---|---|---|---|---|---|---|---|---|
| Inventive product | 21 | A-4 | B-2 | — | 50 | 50 | 0 | 0.321 | 52.5 | 86.8 | 57 |
| | 22 | A-4 | B-3 | — | 50 | 50 | 0 | 0.320 | 52.7 | 87.0 | 56 |
| | 23 | A-4 | B-4 | — | 50 | 50 | 0 | 0.322 | 52.9 | 87.2 | 64 |
| | 24 | A-4 | B-5 | — | 50 | 50 | 0 | 0.318 | 53.2 | 87.4 | 59 |
| | 25 | A-4 | B-8 | — | 50 | 50 | 0 | 0.307 | 53.4 | 87.7 | 61 |
| | 26 | A-4 | B-9 | — | 50 | 50 | 0 | 0.311 | 53.3 | 87.7 | 63 |
| | 27 | A-4 | B-10 | — | 50 | 50 | 0 | 0.308 | 53.7 | 88.3 | 59 |
| | 28 | A-4 | B-11 | — | 70 | 30 | 0 | 0.306 | 53.5 | 88.2 | 56 |
| | 29 | A-4 | B-11 | — | 50 | 50 | 0 | 0.309 | 54.0 | 87.8 | 61 |
| | 30 | A-4 | B-11 | C-1 | 45 | 45 | 10 | 0.308 | 53.9 | 87.9 | 58 |
| | 31 | A-4 | B-12 | — | 50 | 50 | 0 | 0.300 | 54.1 | 87.5 | 59 |
| | 32 | A-4 | B-13 | — | 50 | 50 | 0 | 0.308 | 53.7 | 87.9 | 60 |
| | 33 | A-4 | B-14 | — | 50 | 50 | 0 | 0.316 | 52.8 | 87.0 | 55 |
| Comparative product | 5 | A-4 | — | — | 100 | 0 | 0 | 0.309 | 53.1 | 87.5 | 48 |
| | 6 | A-4 | — | C-1 | 90 | 0 | 10 | 0.298 | 53.7 | 88.0 | 46 |
| | 7 | — | — | — | 0 | 0 | 0 | 0.336 | 50.9 | 86.0 | 67 |

Concerning Tables 4 to 7, according to the paper quality improver composition for papermaking of the present invention, it is recognized that a pulp sheet having the improved bulky value, the improved brightness and the improved opacity as well as the improved paper-strength is obtained about any one of a deinked pulp and a virgin pulp (LBKP, TMP).

What is claimed is:

1. A process for producing a pulp sheet, which comprises adding a paper quality improver composition anytime before or in the papermaking step; wherein the paper quality improver composition comprises (A) a compound having a lyotropic degree, defined below, of not less than 4% and meeting at least two efficiencies selected from the following paper quality improving efficiencies (i) to (iii), (B) a water-soluble polymer satisfying at least one selected from an average molecular weight of 1000 to 10000000 and a viscosity of 1 to 4000 mPa·s at 25° C. in a 1% aqueous solution thereof and optionally at least one surfactant (C); which composition is internally added before or in papermaking step;

(i) standard improved bulky value of not less than 0.02 g/cm$^3$, (ii) standard improved brightness of not less than 0.5 point, and (iii) standard improved opacity of not less than 0.5 point; and $$\text{lyotropic degree } (\%)=(\alpha_0-\alpha)/\alpha_0\times 100$$

wherein $\alpha$: the water content in a wet sheet obtained by adding 5 parts by weight of the compound which becomes the paper quality improver composition for the papermaking to 100 parts by weight of pulp and subjecting the resultant to the papermaking, and $\alpha_0$: the water content in a wet sheet obtained by subjecting pulp to the papermaking without adding the compound which becomes the paper quality improver composition for papermaking to the pulp.

2. A pulp sheet produced by adding the composition as defined in claim 1 anytime before or in the papermaking step.

3. The process for producing a pulp sheet according to claim 1, wherein a deinked pulp is blended in an amount of 10% or more by weight of a pulp feedstock; and wherein the paper quality improver composition optionally contains at least one surfactant (C).

4. The process for producing a pulp sheet according to claim 1, wherein a deinked pulp is blended in an amount of 10% or more by weight of a pulp feedstock; wherein the compound (A) is (A8) an ester of polyhydric alcohol and a linear or branched fatty acid; and wherein the paper quality improver composition optionally contains at least one surfactant (C).

5. The process for producing a pulp sheet according to claim 1, wherein the composition is added before or during a step where paper layers are formed by draining water from a diluted liquid of a pulp feedstock throughout advance thereof on a wire netting.

6. A process for producing a pulp sheet, which comprises adding a paper quality improver composition anytime before or in the papermaking step;

wherein the paper quality improver composition comprises (A) a compound having a lyotropic degree, defined below, of not less than 4% and meeting at least two efficiencies selected from the following paper quality improving efficiencies (i) to (iii), (B) a water-soluble polymer satisfying at least one selected from an average molecular weight of 1000 to 10000000 and a viscosity of 1 to 4000 mPa·s at 25° C. in a 1% aqueous solution thereof and optionally at least one surfactant (C); which composition is internally added before or in papermaking step;

(i) standard improved bulky value of not less than 0.02 g/cm$^3$, (ii) standard improved brightness of not less than 0.5 point, and (iii) standard improved opacity of not less than 0.5 point; and $$\text{lyotropic degree } (\%)=(\alpha_0-\alpha)/\alpha_0\times 100$$

wherein $\alpha$: the water content in a wet sheet obtained by adding 5 parts by weight of the compound which becomes the paper quality improver composition for the papermaking to 100 parts by weight of pulp and subjecting the resultant to the papermaking, and $\alpha_0$: the water content in a wet sheet obtained by subjecting pulp to the papermaking without adding the compound which becomes the paper quality improver composition for papermaking to the pulp;

wherein the compound (A) is selected from the group consisting of (A1) organosiloxane, (A2) glyceryl ether, (A3) amide, (A4) amine, (A5) an acid salt of amine, (A6) a quaternary ammonium salt, (A7) an imidazol compound, (A8) an ester of a polyhydric alcohol and a linear or branched fatty acid, and (A9) an alkylene oxide-added ester being an ester derived from a polyhydric alcohol and a linear or branched fatty acid and having from more than zero mole to less than 12 moles on the average of $C_{2-4}$ alkylene oxide group per 1 mole of the ester;

and in which a deinked pulp is blended in an amount of 10% or more by weight of a pulp feedstock.

7. The process for producing a pulp sheet according to claim 3 or 6, wherein the ratio by weight of (A) to (B) ranges from 99.999/0.001 to 20/80.

8. The process for producing a pulp sheet according to claim 1, 3 or 6, wherein the composition is added to a pulp feedstock and subsequently the pulp feedstock comprising the composition is subjected to papermaking.

9. The process for producing a pulp sheet according to claim 1, 3 or 6, wherein the compound (A) meets the paper quality improving efficiency (i) and at least one of the paper quality improving efficiencies (ii) and (iii).

10. The process for producing a pulp sheet according to claim 1, 3 or 6, wherein the compound (A) is selected from the group consisting of (A1) organosiloxane, (A2) glyceryl ether, (A3) amide, (A6) a quaternary ammonium salt, (A7) an imidazol compound, (A8) an ester of a polyhydric alcohol and a linear or branched fatty acid, and (A9) an alkylene oxide-added ester being an ester derived from a polyhydric alcohol and a linear or branched fatty acid and having from more than zero mole to less than 12 moles on the average of $C_{2-4}$ alkylene oxide group per 1 mole of the ester.

11. A process for producing a pulp sheet, which comprises adding a paper quality improver composition anytime before or in the papermaking step; wherein the paper quality improver composition comprises (A) a compound having a lyotropic degree, defined below, of not less than 4% and meeting at least two efficiencies selected from the following paper quality improving efficiencies (i) to (iii), (B) a water-soluble polymer satisfying at least one selected from an average molecular weight of 1000 to 10000000 and a viscosity of 1 to 4000 mPa·s at 25° C. in a 1% aqueous solution thereof and optionally at least one surfactant (C); which composition is internally added before or in papermaking step;

(i) standard improved bulky value of not less than 0.02 g/cm$^3$, (ii) standard improved brightness of not less than 0.5 point, and (iii) standard improved opacity of not less than 0.5 point; and $$\text{lyotropic degree } (\%)=(\alpha_0-\alpha)/\alpha_0\times 100$$

wherein $\alpha$: the water content in a wet sheet obtained by adding 5 parts by weight of the compound which becomes the paper quality improver composition for the papermaking to 100 parts by weight of pulp and subjecting the resultant to the papermaking, and $\alpha_0$: the water content in a wet sheet obtained by subjecting pulp to the papermaking without adding the compound which becomes the paper quality improver composition for papermaking to the pulp; and wherein compound (A) is at least one selected from the group consisting of (A1) organosiloxane, (A2) glyceryl ether, (A3) amide, (A4), amine, (A5) an acid salt of amine, (A6) a quaternary ammonium salt, (A7) an imidazol compound, (A8) an ester of a polyhydric alcohol and a linear or branched fatty acid, and (A9) an alkylene oxide-added ester being an ester derived from a polyhydric alcohol and a linear or branched fatty acid and having from more than zero mole to less than 12 moles on the average of $C_{2-4}$ alkylene oxide group per 1 mole of the ester.

* * * * *